United States Patent [19]

Tottori

[11] 4,416,535

[45] Nov. 22, 1983

[54] ELECTROPHOTOGRAPHIC COPYING APPARATUS

[75] Inventor: Takafumi Tottori, Toyokawa, Japan

[73] Assignee: Minolta Camera Kabushiki Kaisha, Osaka, Japan

[21] Appl. No.: 382,354

[22] Filed: May 26, 1982

[30] Foreign Application Priority Data

Jun. 8, 1981 [JP] Japan ..... 56-87733

[51] Int. Cl.[3] ..... G03G 15/00

[52] U.S. Cl. ..... 355/14 D; 118/689; 222/DIG. 1; 355/55

[58] Field of Search ..... 355/14 D, 3 DD, 14 R, 355/55–57, 60; 222/DIG. 1; 118/665, 668, 688, 689, 691; 430/30

[56] References Cited

U.S. PATENT DOCUMENTS

| | | | |
|---|---|---|---|
| 4,050,806 | 9/1977 | Miyakawa et al. | 355/14 D |
| 4,215,930 | 8/1980 | Miyakawa et al. | 118/668 X |
| 4,239,372 | 12/1980 | Iwai | 355/14 R |
| 4,248,527 | 2/1981 | Akiyama et al. | 355/14 D |
| 4,272,182 | 6/1981 | Abe et al. | 355/14 D |
| 4,277,162 | 7/1981 | Kasahara et al. | 355/14 D |
| 4,277,549 | 7/1981 | Tatsumi et al. | 355/14 D |
| 4,304,486 | 12/1981 | Cormier et al. | 355/14 D |
| 4,306,804 | 12/1981 | Sakamoto et al. | 355/14 D |
| 4,341,461 | 7/1982 | Fantozzi | 355/14 D |
| 4,348,100 | 9/1982 | Snelling | 355/14 D |

FOREIGN PATENT DOCUMENTS 55-74564 6/1979 Japan .

*Primary Examiner*—R. L. Moses

*Attorney, Agent, or Firm*—Wenderoth, Lind & Ponack

[57] ABSTRACT

The disclosure is directed to an improved electrophotographic copying apparatus which includes a detector for detecting amount of toner adhering to a reference latent image, a replenishing device for replenishing toner to a developer in a developing device when the toner amount detected by the detector falls below reference toner amount and a correcting device for changing the reference toner amount, and/or voltage of a developing bias power source at a time when the reference latent image is developed, according to an operation for altering original document projecting magnifications, so that toner concentration of the developer may be maintained in the best condition at a reduced size magnification as well as an equal size magnification.

5 Claims, 9 Drawing Figures

ELECTROPHOTOGRAPHIC COPYING APPARATUS

BACKGROUND OF THE INVENTION

The present invention generally relates to an electrophotographic copying apparatus and more particularly, to a toner replenish control system of the electrophotographic copying apparatus.

Commonly, according to a conventional electrophotographic copying apparatus, a constant developing bias voltage is usually applied to a developing electrode in a developing device so that fogging of copied image may be prevented. However, this type of copying apparatus as described above has such a disadvantage that when an original document to be copied is not of good quality, copied images therefrom may also be poor in quality in some cases, since developing characteristic is kept constant at all times regardless of condition of latent image to be developed. For example, when an image of the original document per se is light in shade, the copied image therefrom tends to be also light in shade, while in the case where non-image portions (i.e. background portions) of the original document are colored, unsightly copied images are apt to be produced, with formation of undesirable fogging at the non-image portions.

In order to avoid such problems as described above, there has conventionally been proposed a self-bias system. According to the system, the developing electrode is grounded via an impedance element such as self-bias resistor, and a developing bias power source, and thus, effective developing bias voltage can be controlled according to an overall density of the original document, i.e. an average potential of the entire electrostatic latent image so that a desired copied image can be obtained. For example, when the entire original document is light in shade, the potential of the electrostatic latent image is lowered, so that a desirable copied image, which is darker in shade than the actual original document, may be obtained. Therefore, according to the self-bias system as described above, an operator can obtain a desired copied image almost without any special operation of the copying apparatus with respect to an ordinary original document, and only when he still desires to obtain dark copied images even by neglecting formation of the fogging, he may control the density of the copied image by adjusting amount of exposure and the like.

In the meanwhile, in the developing device of the copying apparatus as described above since toner contained in a developer is consumed according to the developing of the electrostatic latent image so that toner concentration, i.e. proportion of weight of the toner to the developer, is lowered, fresh toner must be replenished to the developer accommodated in the developing device. In order to accomplish such toner replenishment, conventionally there has been provided a toner replenish control system in which the amount of the toner to be replenished to the developer in the developing device is controlled so as to maintain the toner concentration constant. A typical toner replenish control system conventionaly proposed includes a black reference image provided adjacent to a platform for an original document, and light image of the black reference image is projected onto a surface of a photoreceptor so that a corresponding reference latent image is formed on the surface of the photoreceptor. The reference latent image is subsequently developed by the developing device. The toner replenish control system further comprises a light emitting element for emitting light to the developed reference latent image and a light receiving element for receiving reflection light from the developed reference latent image, the light receiving element producing signal which corresponds to an amount of the reflection light received by the light receiving element, i.e. amount of the toner adhering to an area of the latent image which is proportional to the concentration of toner in the developing material, and toner replenish control device for controlling the amount of fresh toner to be replenished so as to maintain constant the concentration of the toner in the developing material.

However, if the self-bias system and the toner replenish control system would be simultaneously employed for the electrophotographic apparatus, there may arise such a disadvantage that, since a size of the reference latent image, in other words, retained charge at the area of the reference latent image, may vary due to modification of an original document image projecting magnification, the effective developing bias voltage controlled by means of the self-bias resistor also varies with a consequent variation in the amount of toner adhering to the area of the reference latent image. As a result, the toner replenishing can not be correctly controlled, thus, a desired copied image may not be obtained. For example, at a reduced size magnification, the size of the reference latent image is reduced, and this results in that the retained charge at the latent image becomes less, so that an absolute value of the effective developing bias voltage produced by the self-bias resistor becomes less than that at equal size magnification, thus amount of toner at a unit area adhering to the reference latent image becomes larger than that at equal magnification. Therefore, although toner should be replenished, the toner is not actually replenished to the developer, and thus the density of the copied image become less than a desired density.

Such a fact as described above has been proved by experiments carried out by the present inventor in which an apparatus as shown in FIGS. 1(A) and 1(B) was employed.

The apparatus of FIG. 1(A) generally includes a photoreceptor drum 1 applied with a photosensitive layer of $CdS.nCdCO_3$ resin on the peripheral outer surface thereof and rotatably disposed below and adjacent to an original document platform 28 of a transparent material such as glass or the like, and a developing sleeve 7 provided adjacent to the photosensitive surface layer of said photoreceptor drum 1 in a relation parallel to an axis of said drum 1 as shown. The photoreceptor drum 1 has a width of 310 mm and is charged at −600 V by a corona charger (not shown), while the developing sleeve 7 disposed adjacent to the photoreceptor drum 1 has the same width as that of the photoreceptor drum 1. The developing sleeve 7 is grounded via a self-bias resistor $R_0$ and a developing bias power source 10. The self-bias resistor $R_0$ may be connected to either the input terminal of the developing bias power source 10 as shown in FIG. 1(A) or to the output terminal of the developing bias power source 10 as shown in FIG. 1(B). The self-bias resistor $R_0$ has resistance of 200 MΩ, while the developing bias power source 10 has voltage of −300 V. In the meanwhile, a longitudinal plate 30 with a reference image 29, i.e. reference pattern, is arranged adjacent to the platform 28 for the original document in a position at a starting side of a light scanning for the purpose of reading the original document. The reference image 29 is located at a central portion of the plate 30 which forms a white background, and has a width of 60 mm. The color of the reference image 29 is black with a density at 1.5.

The results of the experiments excuted by using the apparatus as described above are as shown in the following table.

| | equal size magnification (× 1.0) | reduced size magnification (× 0.647) |
|---|---|---|
| effective developing bias voltage during developing the reference latent image | −345 V | −321 V |
| amount of toner adhering to the area of the reference latent image | 0.6 mg/cm$^2$ | 0.657 mg/cm$^2$ |

SUMMARY OF THE INVENTION

Accordingly, an essential object of the present invention is to provide an electrophotographic copying apparatus of a type having an original document image exposure device in which original document image projecting magnification is changeable, as well as both of a toner replenish control system and a self-bias system, in which desired amount of toner can be replenished into a developer accommodated in a developing device and desired copied image at the constant density can be always obtained at various original document image projecting magnifications.

A further object of the present invention is to provide an electrophotographic copying apparatus of the above described type which is simple in construction and accurate in functioning at high reliability.

In accomplishing these and other objects, according to the present invention, there is provided an electrophotographic copying apparatus which includes a correcting means for changing a reference toner amount in the toner replenish control system, and/or voltage of the developing bias power source at a time when the reference latent image is developed. The correcting means is so arranged that the toner concentration of the developer may be always maintained constant at a reduced size magnification as well as an equal size, i.e. life size magnification.

BRIEF DESCRIPTION OF THE DRAWINGS

These and other objects and features of the present invention will become apparent from the following description taken in conjunction with a preferred embodiment thereof with reference to the accompanying drawings, in which.

Before the description of the present invention proceeds, it is to be noted that like parts are designated by like reference numerals throughout views of the accompanying drawings.

DETAILED DESCRIPTION OF THE INVENTION

Figure 1A:
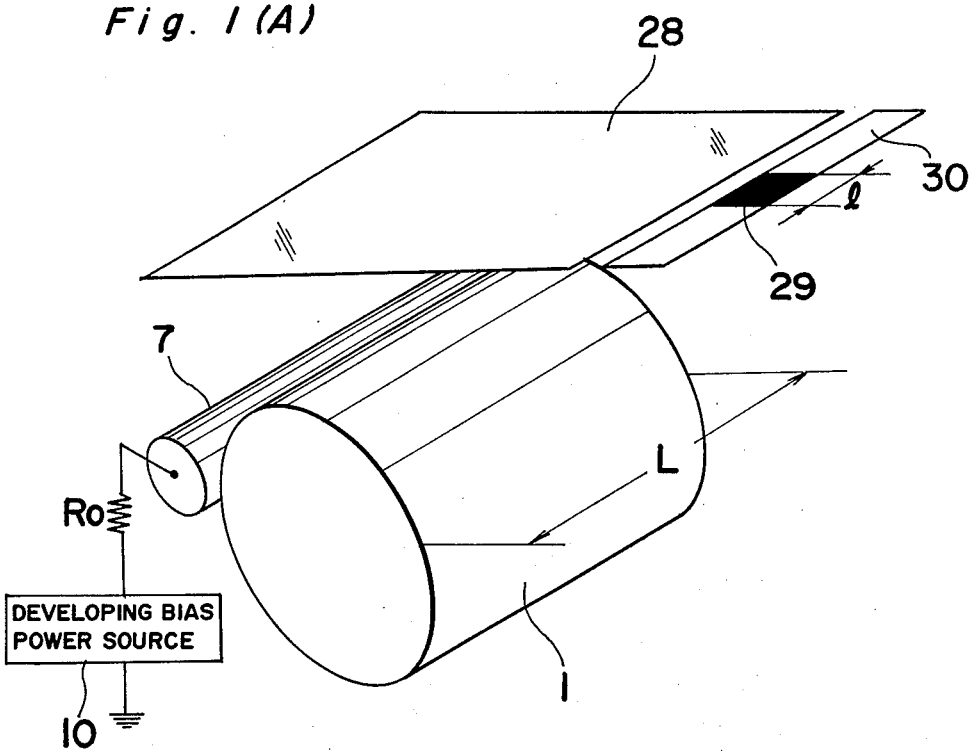
FIGS. 1(A) and 1(B) are schematic perspective views showing an essential parts of a conventional electrophotographic copying apparatus, which was already described.
Figure 1B:
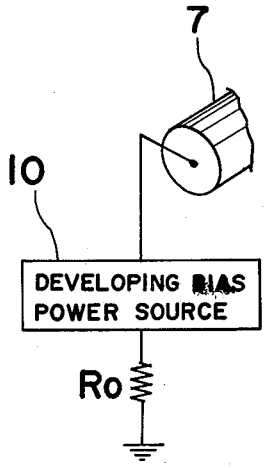
Figure 2:
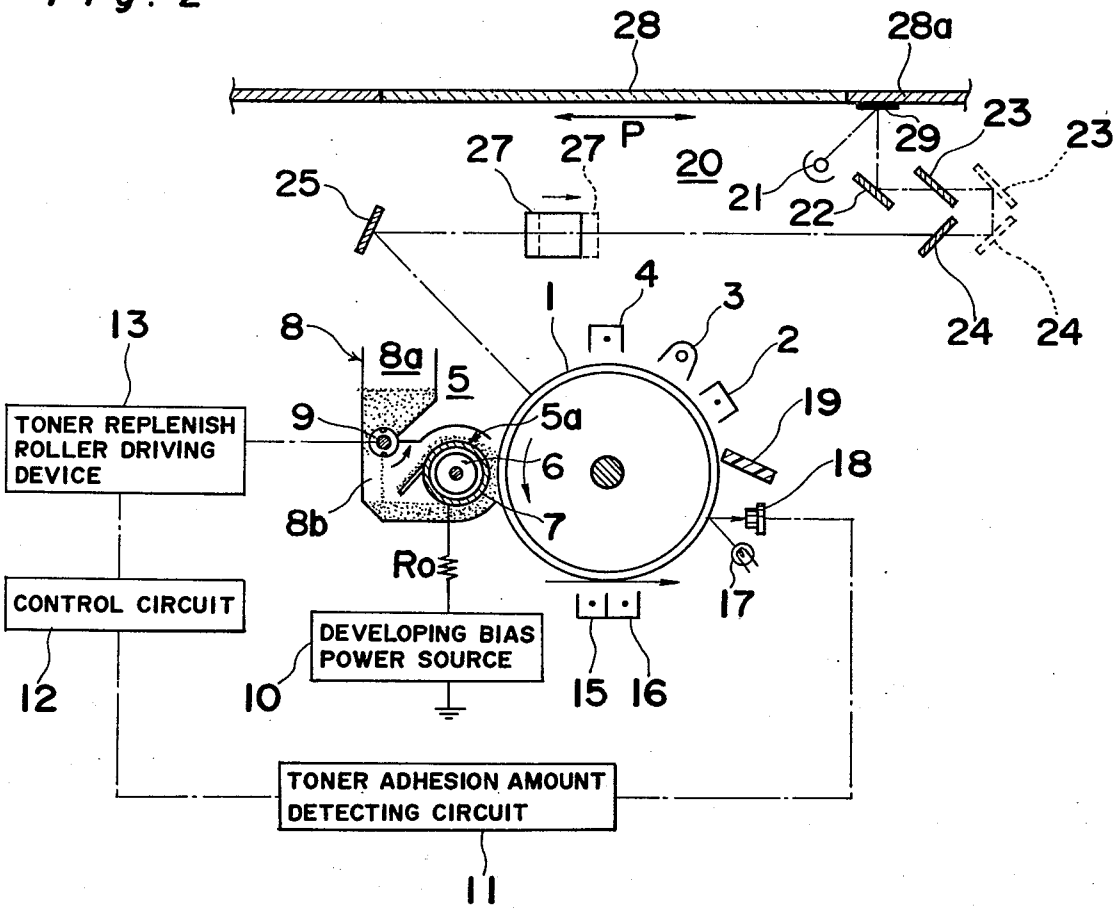
FIG. 2 is a schematic diagram of an electrophotographic copying apparatus according to the present invention.

Referring to FIG. 2, there is shown an electrophotographic copying apparatus according to the present invention.

The copying apparatus shown in FIG. 2 has a photosensitive or photoreceptor drum 1 which is arranged to rotate in the counterclockwise direction and applied with a photosensitive layer of $CdS.CdCO_3$ resin material on its peripheral outer surface, and around which there are sequentially disposed a plurality of processing stations such as a corona charger 4 for preliminarily charging the photosensitive surface of the photoreceptor drum 1, a developing device 5 for developing an electrostatic latent image, which has been formed on the photosensitive surface of the drum 1 through an exposure device 20, into a visible toner image, a transfer charger 15 for transferring the visible toner image onto a copying sheet, a separation charger 16 for facilitating sheet separation from the drum 1, a light emitting element 17 for emitting light towards a reference latent image formed on the surface of the drum 1, a light receiving element 18 for receiving reflection light from the reference latent image and detecting reflection light density corresponding to the amount of toner adhering the reference latent image, a cleaning blade 19 for cleaning excessive toner on the surface of the drum 1 remaining after transfer of the toner image from the surface of the drum 1 onto the copying paper, a sub-charger 2 for charging the surface of the drum 1 and an eraser lamp 3 for erasing a remaining charge on the surface of the drum 1.

The exposure device 20 comprises a light source lamp 21 for projecting light towards a glass platform 28 for a original document to be copied (not shown), reflection mirrors 22, 23, 24 and 25 suitably inclined for successively transmitting the reflected light from the original document and, a projecting lens 27 disposed in a light path between the reflection mirrors 24 and 25. The exposure device 20 is of a type in which the optical system is arranged to reciprocate in a direction indicated by arrows P with respect to the platform 28. At the image projection, the light source lamp 21 and the reflection mirror 22 are arranged to move in one unit in the leftward direction in FIG. 2, at a velocity of v/n (v: circumferential velocity of the drum 1, n: original document image projecting magnification). While the other reflection mirrors 23 and 24 are arranged to move in one unit in the leftward direction at a velocity of v/2n. The reflection mirrors 23 and 24, and projection lens 27 are so arranged as to start for scanning and reading the original document on the platform 28, from a position indicated by solid lines for the equal size magnification, and to start from a position indicated by dotted lines for the reduced size magnification.

A reference image 29 is attached to a bottom surface of a frame 28*a*, which supports the peripheral portion of the platform 28, at one side thereof adjacent to the right side of the platform 28 in FIG. 2. The reference image 29 is initially exposed to the light from the light source lamp 21 before the original on the platform 28 when the light source lamp 21 scans them.

In the meanwhile, the developing device 5 as described previously comprises a tank 8 which includes an toner tank 8*a* and a developer tank 8*b*, a toner replenish roller 9 with recesses on the surface thereof disposed at a bottom of the toner tank 8*a* so as to rotate to feed the toner in the toner tank 8*a* into the developer tank 8*b*, a magnetic brush developing member 5*a* which is disposed in the toner tank 8*b* and which includes a developing sleeve 7 and a magnetic roller accommodated in the developing sleeve 7. The developing sleeve 7 is grounded via a self-bias resistor $R_0$ and a developing bias power source 10.

The light receiving element 18 is connected to a toner replenish roller driving device 13 via a toner adhesion amount detecting circuit 11 and a control circuit 12. When the light receiving element 18 receives reflection light from the reference latent image, it produces signal corresponding to density of the reflection light from the reference latent image. The signal produced from the light receiving element 18 is applied to the toner adhesion detecting circuit 11, by which the amount of the toner adhering to the reference latent image is detected. The toner adhesion amount detecting circuit 11 produces signal which represents amount of the toner adhering to the reference latent image. The signal produced from the toner adhesion amount detecting circuit 11 is applied to the control circuit 12. When the control circuit 12 detects that the amount of the toner adhering to the reference latent image falls below a predetermined reference toner amount, for example 0.6 mg/cm$^2$, it drives the toner replenish roller driving device 13 during a given time so that the toner replenish roller 9 rotates to replenish the toner in the toner tank 8*a* to the developer in the developer tank 8*b*.

Figure 3A:
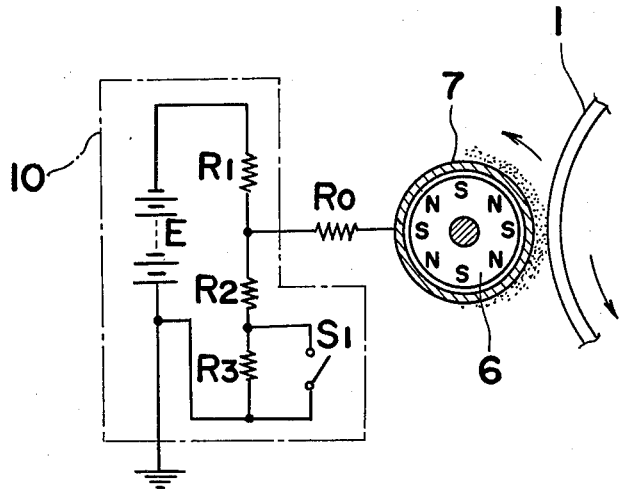
FIG. 3(A) is an electric circuit diagram for essential parts included in the copying apparatus shown in FIG. 2 according to a first embodiment of the present invention, FIGS. 3(B), (C), (D) and (E) respectively show circuit constructions according to modifications of the circuit arrangement shown in FIG. 3(A)

Referring to FIG. 3(A), which illustrates one preferred embodiment of the present invention, developing bias voltage dividing resistor $R_1$, $R_2$ and $R_3$ are connected in series to a battery E, the plus terminal of which is grounded. One end of the self-bias resistor $R_0$ is connected to a junction between the resistor $R_1$ and $R_2$. A switch $S_1$ is connected to a junction between the resistor $R_2$ and $R_3$ and the plus terminal of the battery E, in parallel relationship with respect to the resistor $R_3$. The switch $S_1$ is so arranged as to be turned on and off according to an operation for changing-over of the original document image projecting magnification, for example the shift operation of the projecting lens 27 and the rotating operation of the photoreceptor drum 1. In other words, the switch S1 is turned off only when the reference latent image passes the developing device 5 at a reduced size magnification.

According to this embodiment, the resistance of the self-bias resistor $R_0$ is 200 MΩ, the resistance of the bias voltage dividing resistor $R_1$ and $R_2$ are respectively 1 MΩ, and that of the bias voltage dividing resistor $R_3$ is 0.274 MΩ, while the voltage of the battery E is −600 V. Therefore, when the switch S1 is turned on, the developing bias voltage of −300 V is applied to the developing sleeve 7 via the self-bias resistor $R_0$.

Upon employment of the developing bias power source 10 having such a circuit construction as described above, the effective developing bias voltage during developing the reference latent image is maintained at a constant value, i.e. −345 V at both of equal size magnification and reduced size magnification (×0.647). Therefore, although the retained charge at the reference latent image is different between that at the equal size magnification and that at the reduced size magnification, the amount of the toner adhering to the latent image is kept constant, and thus the toner replenishing can be correctly controlled so that the toner concentration of the developer in the developer tank 8*b* may be maintained constant.

Meanwhile, in the present embodiment, copying experiments were carried out by the present inventor in such a manner that, with the toner concentration of the developer at the initial stage of experiment set at 10% by weight, copying of 100 copy paper sheets at equal size magnification and copying of another 100 copy paper sheets at reduced size magnification (×0.647) were respectively repeated five times alternately to effect copying of 1000 sheets in total, with the finding that the toner concentration of the developer in the tank 8*b* during the above copying period was accurately controlled within the range of 9.8 to 10.2% by weight.

It is to be noted here that the resistance of the bias voltage dividing resistor $R_1$ should be designed to be smaller by more than two digits, than that of the self-bias resistor $R_0$, since the bias voltage dividing resistor $R_1$ may also function as a self-bias resistor.

The developing bias power source 10 may be modified as shown in FIGS. 3(B), 3(C), 3(D) and 3(E).

Figure 3B:
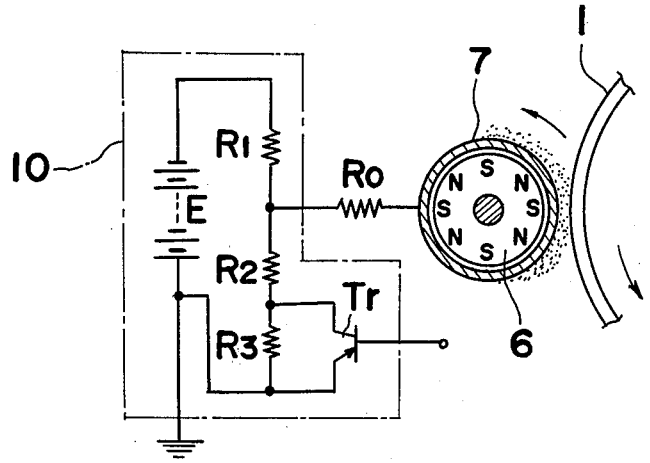

According to a modification shown in FIG. 3(B), the switch $S_1$ employed in FIG. 3(A) is replaced by a switching transistor Tr, to the base of which electric current is applied according to the operation for changing-over of the original document image projecting magnification.

Figure 3C:
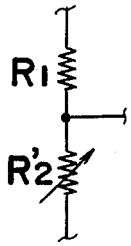

According to other modification shown in FIG. 3(C), the bias voltage dividing resistor $R_3$ and the switch $S_1$ employed in FIG. 3(A) are replaced by a variable resistor $R'_2$, the resistance of which can be so controlled according to the change of original document image projecting magnification, as to be set at a proper value, in other words, at a value at the reduced size magnification larger than that at the equal size magnification.

Figure 3D:
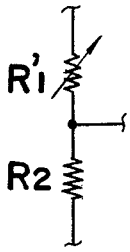

In the modification shown in FIG. 3(D), a variable resistor $R'_1$ replaces the resistor $R_1$ shown in FIG. 3(A) and also the resistor $R_3$ and the switch $S_1$ are taken off. The resistance of the variable resistor $R'_1$ is also so controlled according to the change of the original document image projecting magnification as to be set at a proper value, in other words, at a value at the reduced size magnification smaller than that at the equal size magnification.

Figure 3E:
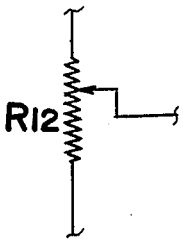

As shown in FIG. 3(E), the switch $S_1$ and three bias voltage dividing resistors $R_1$, $R_2$ and $R_3$ may also be replaced by one variable resistance $R_{12}$.

Figure 4:
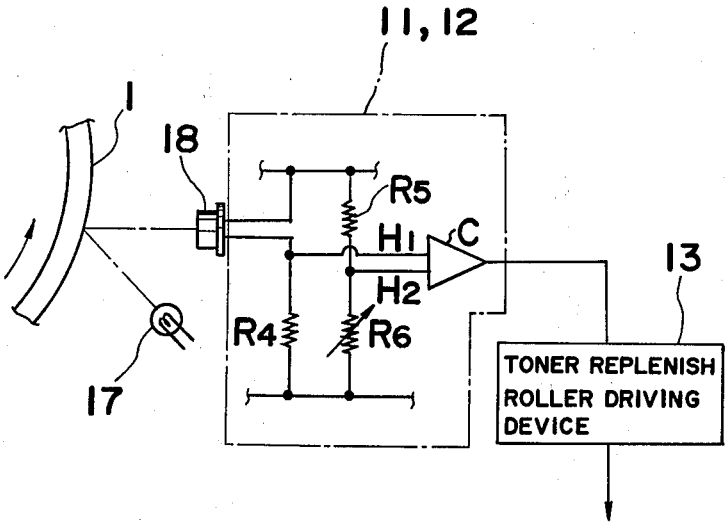
FIG. 4 is an electric circuit diagram for essential parts included in the copying apparatus shown in FIG. 2 according to a second embodiment of the present invention.

FIG. 4 shows a second embodiment of the present invention in which the reference amount of the toner, which is to be a reference for replenishing the toner in the toner tank 8*a* into the developer tank 8*b*, is arranged changeable according to the change-over of the original document image projecting magnification.

Referring to FIG. 4, there is provided a circuit 11, 12 including both of the toner adhesion amount detecting circuit 11 and the control circuit shown in FIG. 2. The circuit 11, 12 comprises a resistor $R_4$ connected in series to an output terminal of the light receiving element 18, a resistor $R_5$ and a variable resistor $R_6$ which are connected in series to each other, and connected to parallel to a power source (not shown) with respect to the series-connection of the light receiving element 18 and the resistor $R_4$, and a comparator C, one input terminal $H_1$ of which is connected to a junction between the light receiving element 18 and the resistor $R_4$, and the other input terminal $H_2$ of which is connected to a junction between the resistor $R_5$ and the variable resistor $R_6$, while the output terminal thereof is connected to the toner replenish roller driving device 13.

According to this embodiment as described above, the voltage of the developing bias power source 10 is fixed at −300 V. When the input voltage to the terminal $H_1$ exceeds the input voltage applied to other terminal $H_2$, the comparator C produces signal for operating the toner replenish roller driving device 13 during a given time to rotate the toner replenish roller 9 so that a predetermined amount of toner is replenished from the toner tank 8*a* to the developer tank 8*b*. The variable resistor $R_6$ is so arranged that the resistance thereof automatically varies according to the operation for changing-over of the original document image projecting magnification. According to this embodiment, the resistance of the variable resistor $R_6$ is respectively set at a predetermined value so that the comparator C is turned on when the amount of the toner adhering to the reference latent image falls below degree of 0.6 mg/cm$^2$ at the equal size magnification and below degree of 0.657 mg/cm$^2$ at the reduced size magnification. Therefore, although the amount of the toner adhering to the reference latent image differs from that at the equal size magnification and at the reduced size magnification, proper signal can be applied from the circuit 11, 12 to the toner replenish roller driving device 13 so that the device 13 may replenish the toner in the toner tank 8*a* into the developer tank 8*b* so as to maintain constant the toner concentration of the developer tank 8*b*.

It is to be noted that the second embodiment as described above can also be modified in such a manner that the variable resistor $R_6$ is replaced by a fixed resistance, while anyone of the fixed resistors $R_4$ and $R_5$ is replaced by a variable resistor. It is essential in the second embodiment that the resistance of each resistor in a bridge circuit is so set as to satisfy the following formula.

$$R:R_4=R_5:R_6$$

wherein R: resistance of the light receiving element 18 at the time when the reference amount of the toner is detected.

It should be noted that, although the electrographic copying apparatus described with reference to the foregoing embodiments is of a type having two original document projecting magnifications, such copying apparatus may be of other type having more than two original projecting magnifications.

It should also be noted that, although the electrographic copying apparatus described as employed in the foregoing embodiments is of a type in which either the voltage of the developing bias power source or the reference toner amount in the toner replenish control system is controlled, such copying apparatus may be of other type in which both of them may simultaneously be controlled.

As is clear from the foregoing description, according to the present invention, since the electrographic copying apparatus comprised a toner replenish control system, a self-bias system and a correcting means for changing reference toner amount in the toner replenish control system and/or voltage of the developing bias power source at a time when the reference latent image is developed, the toner concentration of the developer in the developing device may be always maintained constant at various original document image projecting magnifications.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be constructed as included therein.

What is claimed is:

1. An electrophotographic copying apparatus which comprises an original document image exposure device in which original document magnification with respect to a photosensitive surface of a photoreceptor is changeable, a developing device for developing an electrostatic latent image formed on the photosensitive surface of the photoreceptor, a developing electrode provided within the developing device and grounded via an impedance element and a developing bias power source, a black reference image with white background which is arranged adjacent to a platform for the original document so that a reference latent image corresponding to the reference image is formed on the photosensitive surface of the photoreceptor, a detector for detecting amount of toner adhering to said reference latent image after development of the reference latent image by said developing device, means for replenishing toner to a developer in said developing device when the toner amount detected by the detector falls below reference toner amount, a correcting means for changing the reference toner amount and/or voltage of the developing bias power source according to an operation for changing the original document magnification.

2. An electrophotographic copying apparatus is claimed in claim 1, wherein said correcting means comprises means for setting the voltage of said developing bias power source at high level when the original document projecting magnification is set at a reduced size magnification.

3. An electrophotographic copying apparatus as claimed in claim 2, wherein said correcting means comprises means for setting the voltage of said developing bias power source at high level only when the reference latent image is developed at the reduced size magnification.

4. An electrophotographic copying apparatus as claimed in claim 1, wherein said correcting means comprises means for setting the reference toner amount, which corresponds to a first magnification at a value smaller than said reference toner amount would be set at a second larger size magnification.

5. An electrophotographic copying apparatus as claimed in claim 1, wherein said correcting means is so arranged as to simultaneously change voltage of said developing power source and said reference toner amount.

* * * * *